United States Patent [19]

Agapiou

[11] Patent Number: 4,815,607

[45] Date of Patent: Mar. 28, 1989

[54] SAFETY AWARENESS KIT INCLUDING TOY FIGURES

[76] Inventor: Charles J. Agapiou, 265 Arnold La., Orange, Conn. 06477

[21] Appl. No.: 173,932

[22] Filed: Mar. 28, 1988

[51] Int. Cl.[4] ..... B65D 69/00

[52] U.S. Cl. ..... 206/579; 206/457; 220/376; 277/8 N; 434/305; 446/75; 446/268; D9/308; D21/153; D21/163

[58] Field of Search ..... 206/216, 223, 232, 457, 206/579; 434/305, 433; 446/72, 75, 76, 768, 369; 272/8 R, 8 N; 220/376, DIG. 13; D9/307, 308, 310; D21/148, 153, 163, 187, 188

[56] References Cited

U.S. PATENT DOCUMENTS

| | | | |
|---|---|---|---|
| D. 82,802 | 12/1930 | Disney | D21/188 |
| D. 167,289 | 7/1952 | Tillstrom | D21/153 |
| D. 186,119 | 9/1959 | Heinson et al. | D21/153 |
| 2,779,459 | 1/1957 | Waterman | 206/216 |
| 2,929,170 | 3/1960 | Brown et al. | D21/153 X |
| 3,497,992 | 3/1970 | Balter . | |
| 4,285,157 | 8/1981 | Lambert . | |
| 4,356,915 | 11/1982 | Phillips . | |
| 4,527,688 | 7/1985 | Jones et al. . | |
| 4,577,753 | 3/1986 | Markal | 206/232 |

*Primary Examiner*—Jimmy G. Foster
*Assistant Examiner*—Bryon Gehman
*Attorney, Agent, or Firm*—Bachman & LaPointe

[57] ABSTRACT

The present invention relates to an educational kit for increasing safety awareness. The kit includes a container in the shape of a tire and at least one toy figure preferably in the form of an animal having a flattened portion and simulated tire tread attached to the flattened portion. The container has an interior compartment for storing the toy figure(s), simulated tire tread about a portion of its periphery and a substantially flat base portion for enabling the container to stand erect.

11 Claims, 2 Drawing Sheets

SAFETY AWARENESS KIT INCLUDING TOY FIGURES

BACKGROUND OF THE INVENTION

The present invention relates to an educational kit for increasing safety awareness, in particular pedestrian safety awareness.

Each year hundreds of pedestrians, old and young, are seriously injured or killed merely by stepping off a curb into the path of an oncoming car or by entering into a cross walk without first looking both ways. Efforts have been made to prevent such injuries or deaths through public safety awareness programs designed to heighten safety awareness. Campaigns are carried out in almost all schools to educate young children and adults in these matters. The most effective campaigns have been those which grab the attention of their audience. For young children, the successful campaigns are often those that involve some character which children can relate to.

Accordingly, it is an object of the present invention to provide an educational kit for increasing safety awareness.

It is a further object of the present invention to provide an educational kit as above intended to heighten the safety awareness of young children.

These and other objects and advantages will become more apparent from the following description and drawings.

SUMMARY OF THE INVENTION

The foregoing objects are achieved by an educational kit which comprises at least one toy figure having a flattened portion which a simulated tire tread attached thereto and a container in the form of a tire having an interior compartment for storing the toy figure(s). In a preferred embodiment, the kit includes a plurality of animal-like figures, such as dog-like or possum-like figures, each having a piece of simulated tire tread attached to a flattened central portion of its body. The tire-like storage container is characterized by a substantially flat base portion for enabling the container to stand erect, simulated tire tread on a portion of its outer periphery, an opening in a side wall to gain access to the interior compartment, and a lid or cover for closing the opening. The kit further includes printed matter for promoting safety awareness such as a safety slogan affixed to at least one side wall of the container.

The kit of the present invention is believed to be particularly useful in educating young children. By placing a toy figure with the tire tread on its back under or in close proximity to the tire, a lasting visual impression of the hazards of pedestrian carelessness can be imparted to the child.

DETAILED DESCRIPTION

Figure 2:
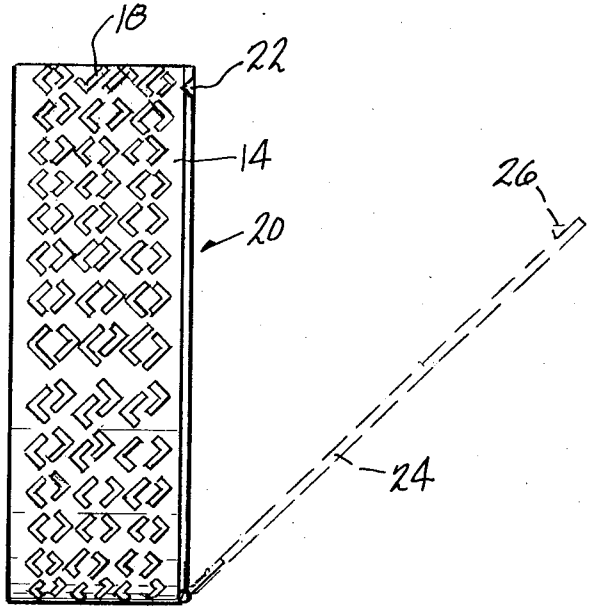
FIG. 2 is a side view of the tire-like container of FIG. 1.
Figure 1:
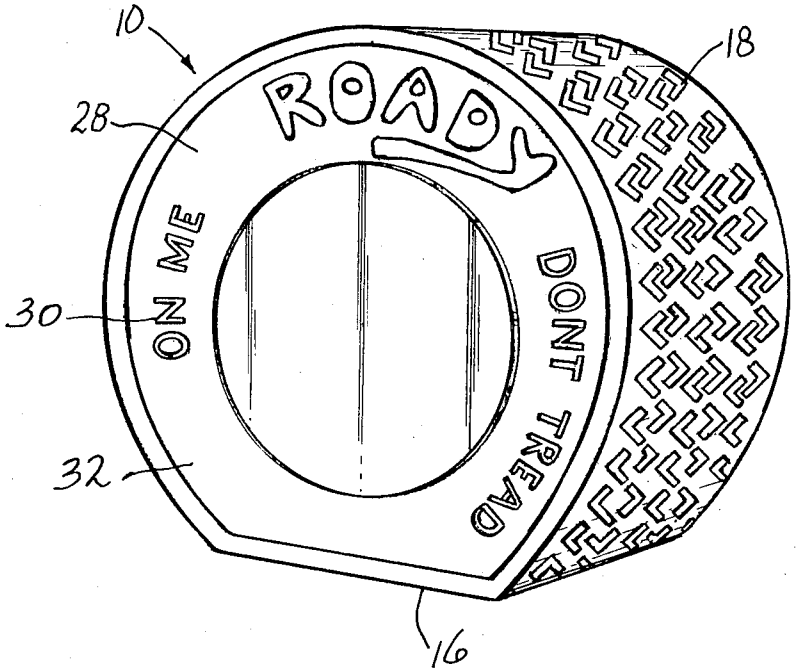
FIG. 1 is a perspective view of the tire-like container for storing the toy figure(s)

The educational kit for increasing safety awareness of the present invention includes a tire-like storage container 10 and at least one toy figure 12, preferably a plurality of figures. Referring now to FIGS. 1 and 2, the container 10 is substantially circular in profile so as to have a tire-like appearance. The container 10 is formed with an interior compartment 14 in which the toy figure(s) 12 may be stored. The container 10 is further characterized by a substantially flat base portion 16 and simulated tire tread 18 about a portion of its outer periphery. The substantially flat base portion 16 enables the container 10 to be free-standing while the simulated tire tread 18 enhances its tire-like appearance.

An opening 20 is provided in one side wall 22 of the container to permit access to the storage compartment 14. A cover 24 having a locking mechanism 26 may be provided to close the opening 20. The cover 24 may be hinged to the side wall 22 to facilitate its opening and closing. The locking mechanism 26 may comprise any suitable locking mechanism known in the art. Alternatively, the cover 24 may be omitted.

The side wall 28 opposed to the side wall 22 may if desired be provided with printed indicia 30. For example, a slogan such as "Cross At The Green and Not In Between" or "Don't Tread on Me" may be painted on the side wall. Alternatively, a tag or label containing the safety slogan may be adhesively affixed to the side wall. If desired, a white stripe 32 may be provided on each side wall to give the container the appearance of a white-wall tire.

The container 10 may be formed from any suitable material known in the art such as plastic or cardboard. Preferably, it is constructed from a moldable plastic material such as polyethylene, polypropylene or high impact styrene. When the container is formed from such a moldable plastic material, the simulated tire tread 18 may be an integrally molded portion of the container. If the container 10 is formed with smooth surfaces, however, the simulated tire tread 18 may be painted onto the outer periphery.

While it is preferred that the container 10 be formed with the flattened base portion 16, it is also possible to form the container 10 with a completely circular profile and provide a separate base or support structure not shown to enable it to be free standing. When not in use, the base or support structure may be stored in the compartment 14.

While not necessary, a carrying handle not shown may be provided, for example in the base portion, if so desired.

Figure 3:
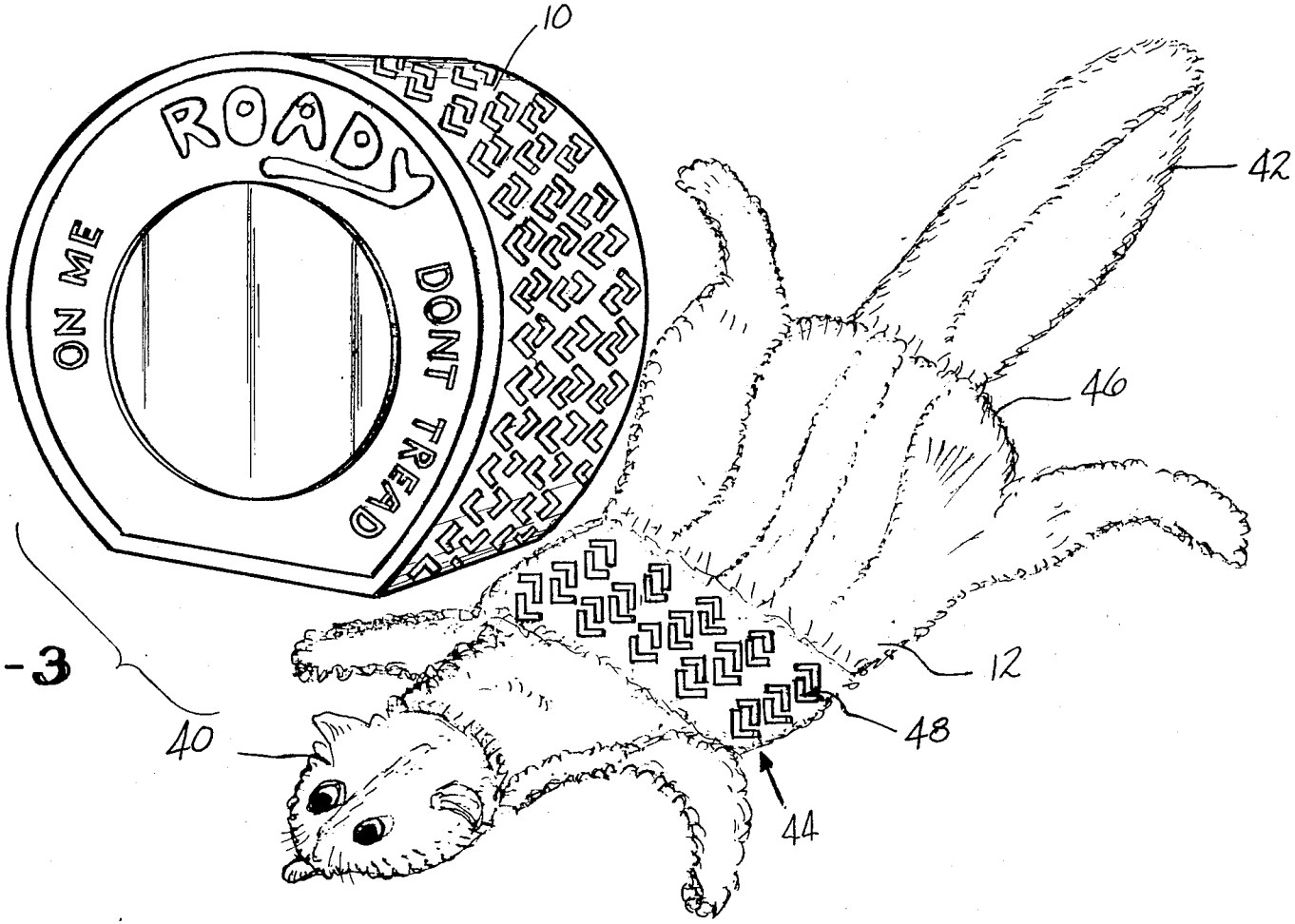
FIG. 3 is a perspective view of a toy figure and the tire-like container forming the kit of the present invention.

The toy figure(s) 12 to be used in the kit may have any desired animal-like appearance such as that of a possum or a dog or alternatively a human-like appearance. In a preferred embodiment of the kit, each figure has an animal-like appearance. As shown in FIG. 3, the toy figure 12 preferably has a head portion 40, a tail portion 42 and a central portion 44. The figure 12 may be formed from any suitable material known in the art. For example, it could be formed from a cloth-like material, a carpet-like material, plastic, or a combination of such materials. The head and tail portions may contain stuffing to enhance the appearance of the figure. The central portion 44 preferably contains no stuffing so as to have a substantially flat appearance when placed on a surface. In a most preferred embodiment, the toy figure 12 has a hollow interior and an opening 46 in the tail portion 42 to enable it to be used as a hand puppet. For reasons which will become more clearer, a piece 48 of simulated tire tread, preferably formed from a plastic material, is affixed to the central portion 44. Any suitable adhesive means known in the art may be used to fasten the simulated tire tread to the central portion 44.

The kit of the present invention may be used as part of a safety awareness presentation. To provide the audience and in particular young children with a visual impression of the consequences of an absence of safety awareness, the toy figure 12 is removed from the container 10 and placed on a surface. The tire-like container 10 is then placed adjacent to or at least partially over the figure 12. In this way, the appearance of a figure having just been run over can be created.

It is apparent that there has been provided in accordance with this invention a safety awareness kit which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An education kit for increasing safety awareness which comprises:

at least one toy figure having a flattened portion and a simulated tire tread on said flattened portion;

a container in the shape of a tire; and said container having an interior compartment for storing said at least one figure.

2. A kit in accordance with claim 1 which further comprises means for enabling said container to stand erect.

3. A kit in accordance with claim 2 wherein said enabling means comprises a substantially flat base portion on said container.

4. A kit in accordance with claim 1 wherein said container has simulated tire tread on a portion of its outer periphery.

5. A kit in accordance with claim 1 wherein said container is capable of being positioned over a portion of said at least one toy figure.

6. A kit in accordance with claim 1 wherein each said figure comprises an animal having a head portion, a tail portion, and a flattened central portion intermediate said head and tail portions and said simulated tire tread is a piece affixed to said central portion.

7. A kit in accordance with claim 1 which further comprises a plurality of toy figures each having a flattened portion.

8. A kit in accordance with claim 1 which further comprises printed indicia for promoting safety awareness.

9. A kit in accordance with claim 8 wherein said printed indicia is located on at least one wall of said container.

10. A kit in accordance with claim 1 wherein said container includes an opening in a wall to gain access to said interior compartment and a cover for closing said opening.

11. A kit in accordance with claim 1 wherein said at least one toy figure may be used as a hand puppet.

* * * * *